US008472822B2

(12) United States Patent
Takenaka

(10) Patent No.: US 8,472,822 B2
(45) Date of Patent: Jun. 25, 2013

(54) IMAGE FORMING APPARATUS AND METHOD CAPABLE OF CHANGING IMAGE FORMATION CONDITION BASED ON DETECTION RESULT OF REFERENCE IMAGE

(75) Inventor: Tomohide Takenaka, Zama (JP)

(73) Assignee: Ricoh Company, Limited, Tokyo (JP)

( * ) Notice: Subject to any disclaimer, the term of this patent is extended or adjusted under 35 U.S.C. 154(b) by 339 days.

(21) Appl. No.: 12/908,289

(22) Filed: Oct. 20, 2010

(65) Prior Publication Data

US 2011/0091224 A1 Apr. 21, 2011

(30) Foreign Application Priority Data

Oct. 21, 2009 (JP) ..... 2009-242772

(51) Int. Cl.
*G03G 15/00* (2006.01)

(52) U.S. Cl.
USPC ..... 399/49; 399/72

(58) Field of Classification Search
USPC ..... 399/11, 49, 72, 74
See application file for complete search history.

(56) References Cited

U.S. PATENT DOCUMENTS 6,147,698 A * 11/2000 Zable et al. ..... 347/240
2010/0080576 A1 4/2010 Nakayama et al.
2010/0129093 A1 5/2010 Nakayama et al.

FOREIGN PATENT DOCUMENTS

JP 2006-234862 9/2006

* cited by examiner

*Primary Examiner* — Hoang Ngo
(74) *Attorney, Agent, or Firm* — Oblon, Spivak, McClelland, Maier & Neustadt, L.L.P.

(57) ABSTRACT

An image forming apparatus includes an image bearer that bears a toner image and a reference toner image, a toner amount detector that detects an amount of toner in the reference toner image, a detected toner amount correction device that corrects the amount of toner detected by the toner amount detector in accordance with a prescribed condition of a previous image formed just before formation of the reference toner image, and a controller that changes a condition of formation of subsequent toner images based on the corrected toner amount.

9 Claims, 3 Drawing Sheets

IMAGE FORMING APPARATUS AND METHOD CAPABLE OF CHANGING IMAGE FORMATION CONDITION BASED ON DETECTION RESULT OF REFERENCE IMAGE

CROSS-REFERENCE TO RELATED APPLICATIONS

This application claims priority pursuant to 35 USC §119 to Japanese Patent Application No. 2009-242772, filed on Oct. 21, 2009, the entire contents of which are hereby incorporated by reference herein.

BACKGROUND OF THE INVENTION

1. Field of the Invention

The present invention relates to an image forming apparatus, such as a copier, a printer, a facsimile machine, etc., and a method capable of changing a condition of forming a toner image on an image bearer in accordance with an amount of toner of a reference toner image formed on the image bearer.

2. Discussion of the Background Art

As discussed in Japanese Patent Application Laid Open Nos. 9-211911 and 2006-234862 (JP-H9-211911-A and JP-2006-234862-A, respectively), it is well known in an image formation process that a photoconductive member serving as an image bearer is charged and exposed to an optical image to change a potential of the exposed section and thereby form a latent image thereon. Toner with a prescribed charge is then electrostatically attracted to the latent image, so that a toner image is formed. The toner image is then transferred onto a transfer member.

Further, various transfer processes are employed in such an image formation process. For example, toner images of component colors are temporarily transferred one after another onto the same portion of an intermediate transfer member to be superimposed thereon. The superimposed toner images are then transferred onto a transfer member at once as a color image. Alternatively, toner images of component colors are transferred onto the same transfer member one after another to be superimposed thereon as a color image without using the intermediate transfer member. Yet further alternatively, toner images of component colors are formed on a photoconductive member one after another to be superimposed thereon and are transferred onto a transfer member all at once as a color image without using the intermediate transfer member.

To keep image density constant in such an image formation process, various devices have been employed. For example, as described in the JP-9-211911-A and JP-2006-234862-A, an image forming apparatus is known which forms a reference toner image having a prescribed pixel pattern at a prescribed time, detects a toner attraction amount per unit area in relation to the reference toner image, and adjusts image formation performance based on the detection result. According to this type of image forming apparatus, when an image formation performance changes due to environmental change or as time elapses, a change in the image formation performance is detected based on a change in the toner attraction amount. An image formation condition, such as a charge voltage on an image bearer, a latent image writing power provided to the image bearer, a developing bias, developer toner density, etc., is then adjusted to recover their original performances. As a result, a change in image density caused by the change in the image formation performance can be suppressed.

In theory, the amount of toner attracted to the reference toner image can be expected to remain constant if the charge voltage on an image bearer, the latent image writing power provided to the image bearer, the developing bias, or the developer toner density and the like are also constant.

However, it is known that, in practice, the amount of toner of the reference toner image is affected by the image formed just before formation of the reference toner image. Consequently, adjustment of image formation conditions based solely on the toner amount of the reference toner image, without regard to the condition of the immediately preceding image, runs the risk of destabilizing the density of succeeding toner images formed thereafter.

SUMMARY OF THE INVENTION

Accordingly, an object of the present invention is to provide a new and novel image forming apparatus. Such a new and novel image includes an image bearer that bears a toner image and a reference toner image, a toner amount detector that detects an amount of toner in the reference toner image, a detected toner amount correction device that corrects the amount of toner detected by the toner amount detector in accordance with a prescribed condition of a previous image formed just before formation of the reference toner image, a controller provided to change a condition of formation of the toner image based on the corrected toner amount.

In another aspect, the detected toner amount correction device adjusts the detected toner amount in accordance with an image area ratio of the previous image.

In yet another aspect, an endless rotary toner bearer is provided to bear the toner forming the toner image and the reference toner image on the image bearer. The previous image is formed on the image bearer over a length corresponding to the circumference of the toner bearer.

In yet another aspect, an endless rotary toner carrier is provided to carry the toner forming the toner image and the reference toner image on the image bearer. The previous image is formed on the image bearer over a length equal to an integer multiple of the circumference of the toner bearer.

In yet another aspect, the detected toner amount correction device corrects the detected toner amount in proportion to an image area ratio of the previous image. The detected toner amount is relatively largely adjusted when the image area ratio is relatively large.

In yet another aspect, the detected toner amount is relatively less corrected when the image area ratio is relatively small.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

PREFERRED EMBODIMENTS OF THE PRESENT INVENTION

Figure 1:
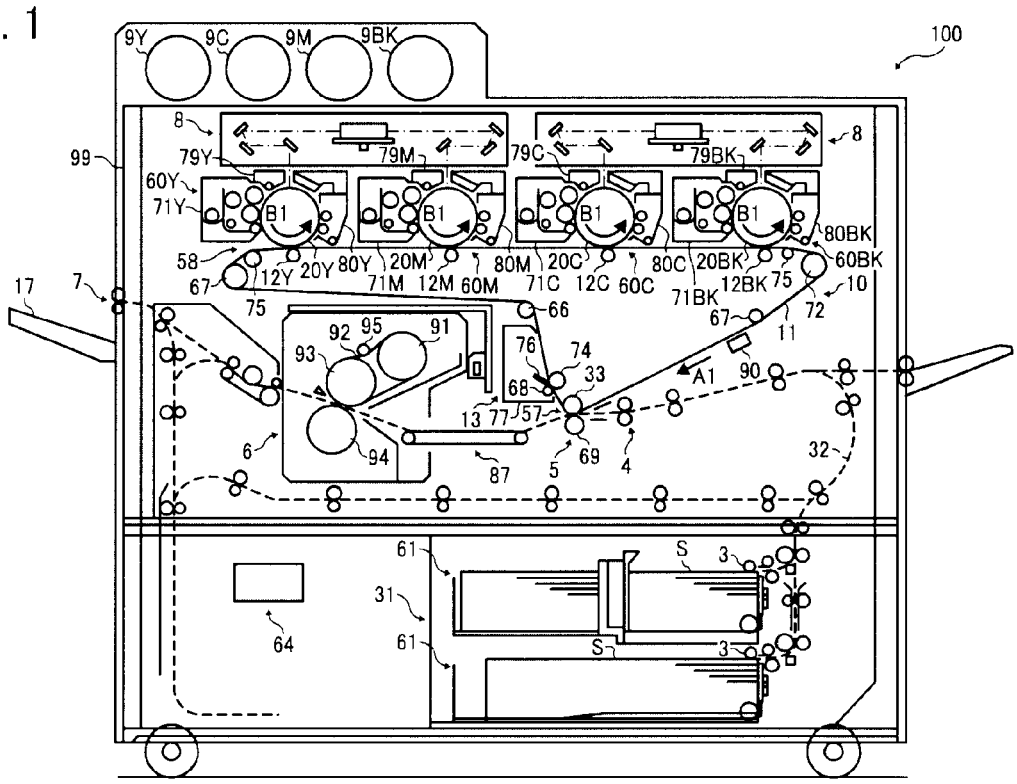
FIG. 1 schematically illustrates an exemplary image forming apparatus to which one embodiment of the present invention is applied.

Referring now to the drawing, wherein like reference numerals designate identical or corresponding parts throughout several views, in particular in FIG. 1, an image forming apparatus 100 employs a color laser printer. However, the image forming apparatus 100 can employ another type of one of a printer, a fax, a copier, and a multifunctional machine constituted by combining the copier and the printer or the like. The image forming apparatus 100 executes image formation processing in accordance with an image signal that corresponds to image information received from an outside thereof. The image forming apparatus 100 executes image formation on a sheet like recording medium, such as a thick sheet S (e.g. an OHP sheet, a card, a post card), an envelope, etc., beside a plain paper generally used for copying.

The image forming apparatus employs a tandem system, so that photoconductive drums 20Y to 20Bk are arranged in parallel to each other as first image bearers to form images of resolution component colors of yellow to black, respectively.

The photoconductive drums 20Y to 20Bk are rotatavely supported by a frame, not shown, of a body 99 of the image forming apparatus 100, with those being arranged in this order in a clockwise direction A1 in which a transfer endless belt 1 travels as an intermediate transfer member from up stream as shown in FIG. 1. As already referred to, legends Y to Bk are assigned to respective numerals to represent yellow to black members, respectively.

Respective photoconductive drums 20Y to 20Bk are provided in image formation units 60Y to 60Bk for forming component color images of yellow to black, respectively.

These photoconductive drums 20Y to 20Bk are located facing an outer circumferential image formation surface of the transfer belt 11.

The transfer belt 11 is movable in the direction shown by the arrow A1 opposing the respective photoconductive drums 20Y to 20Bk. The toner images visualized on the respective photoconductive drums 20Y to 20Bk are transferred and superimposed on the transfer belt 11, and are further transferred on a transfer sheet S at once. Thus, an intermediate transfer system is employed.

The upper side section of the transfer belt 11 faces the photoconductive drums 20Y to 20Bk via sections serving as primary transfer sections 58 where the toner images are transferred there onto, respectively.

Plural primary transfer rollers 12Y to 12Bk are arranged opposing the photoconductive drums 20Y to 20Bk via the transfer belt 11 while receiving bias voltages, respectively. Thus, these primary transfer rollers 12Y to 12Bk execute the primary transfer process at different times on the same position of the transfer belt 11.

The transfer belt 11 has a multi layered structure by including a base layer made of less stretchable material, such as fluorine resin, PVD sheet, polyimide resin, etc., and a coat layer having a good smoothing performance made of material, such as fluorine resin, etc., overlying the base layer.

The transfer belt 11 includes a deviation prevention guides, not shown, at both edges thereof to prevent the transfer belt 11 from being deviating in any one of directions perpendicular to a sheet surface of FIG. 1. Such deviation preventing guides are made of urethane rubber, and can include various rubber materials, such as silicone, etc.

The image forming apparatus 100 includes four-image formation units 60Y to 60Bk and a transfer belt unit 10 having a transfer belt 11 arranged below the respective photoconductive drums 20Y to 20Bk in the body 99. Further included are a secondary transfer device 5 arranged facing the transfer belt 11 from below and an optical scanning devices 8 arranged above the image formation units 60Y to 60BK as optical writing units for optically writing latent images.

The image forming apparatus 100 further includes a sheet feeding device 61 of a sheet cassettes that accommodate a number of transfer sheets S to be conveyed toward a secondary transfer section which is located between the transfer belt 11 and the secondary transfer device 5 in the body. Further included are a pair of registration rollers 4, which launch the recording medium S conveyed from the sheet feeding device 61 toward the secondary transfer section 57 in synchronism with toner images formed on the respective image formation units 60Y to 60Bk. Further included is a sensor, not shown, that recognizes that the tip of the transfer sheet S reaches the pair of registration rollers 4.

Further, the image forming apparatus 100 includes a belt system as a fixing device 6 that fixes the toner image on the recording medium, a belt conveyance device 87 that conveys the recording medium conveyed from the secondary transfer section 57 to the fixing device 6, and a pair of sheet ejection rollers 7 that ejects the recording medium having been subjected to the fixing process to outside of the body 99. Further included are a sheet ejection tray 17 that stacks the recording mediums ejected outside by the sheet ejection rollers 7, and toner bottles 9Y to 9Bk arranged in the upper side of the body 99 to store toner of yellow to black colors, respectively.

Also included is a toner sensor 90 arranged facing the transfer belt 11 to detect an amount of toner and recognize density of the toner images of respective colors, and a driving device, not shown, that drives the respective photoconductive drums 20Y to 20Bk. Yet further included are a controller 64 having a CPU and a memory or the like to generally control the image forming apparatus 100.

The transfer belt unit 10 includes, beside the transfer belt 11, plural primary transfer bias rollers 12Y to 12Bk which provide respective primary biases, a driving roller 72 that drives the transfer belt 11 winding there around, and a cleaning opposite roller 74 that serves as a stretcher roller. Plural stretching rollers 33, 66, 67 and 75 are provided to stretch the transfer belt 11 in cooperation with the driving roller 72 and the cleaning opposite roller 74. Also included is an intermediate transfer medium cleaning device 13 that faces the transfer belt 11 to removes alien material from the surface thereof.

The transfer belt unit 10 further includes a driving system, not shown, that drives the driving roller 72, and a power supply and a bias controller which collectively apply the primary transfer biases to the respective primary transfer rollers 12Y to 12Bk as a primary bias application device.

The cleaning opposite roller 74 and the stretching rollers 33, 66, 67, and 75 are driven by the transfer belt 11 that is driven by the driving roller 72. The primary transfer rollers 12Y to 12Bk press the transfer belt 11 from its rear side toward the photoconductive drums 20Y to 20Bk, thereby forming the primary transfer nips, respectively. Thus, these primary transfer nips are located in a region where the transfer belt 11 is stretched between the stretching rollers 75. Thus, the stretching rollers 75 stably maintain the primary transfer nips.

Plural primary transfer electric fields are formed in the respective primary transfer nips due to functions of the primary transfer biases between the respective photoconductive drums 20Y to 20Bk and the primary transfer rollers 12Y to 12Bk. Thus, the toner images of respective colors formed on the photoconductive drums 20Y to 20Bk are transferred onto the transfer belt 11 being affected by the primary transfer electric fields and nip pressures during the primary transfer process.

The stretching roller 33 contacts the secondary transfer device 5 via the transfer belt 11 thereby forming a secondary transfer section 57. The stretching roller 66 serves as a tension roller and provides a prescribed tension suitable for the transfer process to the transfer belt 11.

The life of the transfer belt 11 is prescribed integer multiple of that of each of the photoconductive drums 20Y to 20BK. Thus, when their lives are completed at the same time as that of the transfer belt 11 is completed, the photoconductive drums 20Y to 20Bk are replaced together with the transfer belt 11. In this way, by designing the life of the transfer belt 11 as about integer multiple of that of the photoconductive drums 20Y to 20Bk, they can be replaced at once. As a result, a maintenance performance can be improved and deterioration of transfer efficiency caused by increase in frication coefficient of the photoconductive drums 20Y to 20Bk, which is caused when their lives are completed and the photoconductive drums are left unused, can be suppressed. Further, an image missing its central part can be suppressed.

However, even though the life of the transfer belt 11 is not about integer multiple of that of the photoconductive drums 20Y to 20Bk, a maintenance performance is similarly improved while suppressing deterioration of transfer efficiency or central part missing images, if the photoconductive drums 20Y to 20Bk are replaced, when their lives almost or completely end at the same time as a life of the transfer belt 11 ends and is replaced.

A cleaning device 13 includes a cleaning blade 76 contacting the transfer belt 11 while pressing against a cleaning opposite roller 74, a brush roller 68 arranged up stream of the cleaning blade 76 while opposing the transfer belt 11 that opposes the cleaning opposite roller 74, and a casing 77 that accommodates the cleaning blade 76 and the brush roller 68.

The cleaning device 13 wipes off foreign material, such as toner, etc., remaining on the transfer belt 11 using a brush roller 68 and/or the cleaning blade 76. The cleaning device 13 also wipes off reference toner images of respective component colors formed on the transfer belt 11 in the respective image formation units 60Bk to 60C as reference patterns during process control.

The sheet-feeding device 61 of multiple steps is arranged below the optical scanning device 8 in the lower site in the body 99 to accommodate plural transfer recording mediums S being stacked. Thus, the sheet-feeding device 61 constitutes a paper bank 31 on the bottom of the casing 99.

The sheet feeding device 61 includes a sheet feeding roller 3 that presses against the topmost transfer sheet S and is driven and rotated counter clockwise at a prescribed time, so that the topmost sheet S is fed toward a pair of registration rollers 4. The transfer sheet S launched from the sheet feeding device 61 arrives at the pair of registration rollers 4 via a sheet conveyance path 32, and is then pinched therebetween.

The secondary transfer device 5 is arranged opposite the stretching roller 33. The secondary transfer device 5 includes a secondary transfer roller 69 arranged to pinch the transfer belt 11 with the stretching roller 33, a driving device, not shown, that drives the secondary transfer roller 69, and a power supply, not shown, that applies a voltage to the secondary transfer roller 69. The secondary transfer roller 69 separates from the transfer belt 11 during the process control as mentioned later in detail.

The fixing device 6 includes a heating roller 91 having a heat source inside, a fixing belt 92 wound around the heating roller 91, and a fixing roller 93 and an auxiliary roller 95 by which the fixing belt 92 is wound beside the heating roller 91. Also included is a pressing roller 94 pressing against the fixing roller 93 via the fixing belt 92. Thus, when the sheet S bearing the toner image thereon is conveyed through a pressure contacting section located between the fixing belt 92 and the pressing roller 94, the toner image is fixed onto the surface of the sheet S by functions of the heat and pressure.

The optical scanning device 8 emits a laser light to the respective photoconductive drums 20Y to 20Bk in accordance with image information inputted from the outside of the image forming apparatus 100. When a copier constitutes the image forming apparatus 100, an original document is placed on a platen glass provided in an original document reading device and is optically read when a copy switch provided therein is depressed, the optical scanning device 8 emits a laser light to the respective photoconductive drums 20Y to 20Bk.

Toner of respective colors of yellow, cyan, magenta, and black stored in the toner bottles 9Y to 9Bk are polymerization types. A prescribed amount of the toner is replenished to each of the respective developing devices 80Y to 80Bk of the image formation units 60Y to 60Bk via a conveyance path, not shown, by a prescribed amount to be replenished.

A toner sensor 90 optically detects toner density or an amount of toner of reference toner images of the respective colors transferred on the transfer belt 11 in the image formations 60Bk to 60C during the process control as later mentioned in detail.

Toner density or a toner attraction amount of the reference toner images of the respective colors detected by the toner sensor 90 are stored in a memory provided in the controller 64. Thus, the memory and controller 64 collectively serve as a toner density memory, a tenor attraction amount memory, and a toner amount memory.

The controller 64 calculates an image area ratio based on image information used for ejecting a laser light from the optical scanning device 8, and stores the image area ratio in the memory. Thus, the controller 64 serves as an image area ratio calculation device. The controller 64 and the memory collectively serve as the image area ratio memory.

Now, an exemplary structure of one of the image formation unit 60Y including a photoconductive drum 20Y among the 60Bk to 60C is typically described hereinafter. Specifically, the remaining image formation units have substantially the same structure.

Around the photoconductive drum 60Y, the image formation unit 60Y includes a primary transfer roller 12Y, a cleaning device 71Y to execute cleaning, a charge removing device, not shown, to remove charges, a charge device 79Y to provide AC charge, and a developing device 80Y to execute developing with two-component developer in the clockwise rotational direction B1 thereof as shown in FIG. 1.

The photoconductive drum 20Y rotates in the direction B1 at a prescribed circular velocity. The cleaning device 71Y includes a cleaning blade 20Y that contacts the photoconductive drum 20Y. The cleaning blade 20Y scavenges off toner remaining on the photoconductive drum 20Y after a primary transfer process executed by the primary transfer roller 12Y. The charge-removing device includes a charge-removing lamp that removes charges remaining on the photoconductive drum 20Y after the cleaning process executed by the cleaning device 71Y. The charge device 79Y uniformly charges the surface of the photoconductive drum 20Y having been subjected to the charge removing process executed by the charge-removing device.

Figure 2:
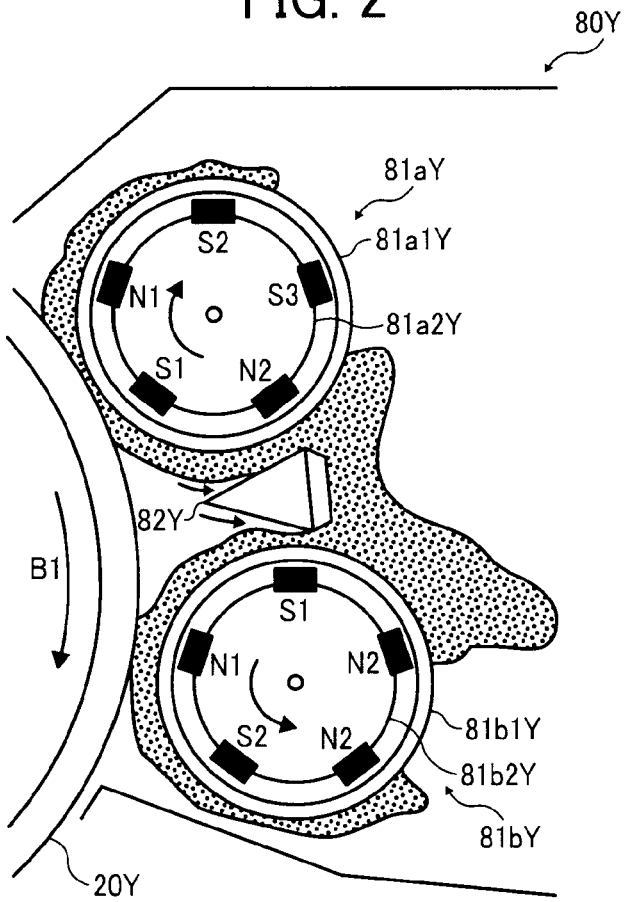
FIG. 2 partially illustrates an exemplary developing device included in the image forming apparatus of FIG. 1 according to one embodiment of the present invention.

As shown in FIG. 2, the developing device 80Y includes a pair of developing rollers 81*a*Y and 81*b*Y bearing two component developer having toner with positive polarity and carrier opposing the photoconductive drum 20Y for forming a toner image thereon. Further included are a doctor blade 82Y arranged between the pair of developing rollers 81*a*Y and 81*b*Y, a developing roller driving motor, not shown, that drives the pair of developing rollers 81*a*Y and 81*b*Y as a driving source, and a high voltage power supply, not shown, that applies developing biases to the pair of developing rollers 81*a*Y and 81*b*Y.

The pair of developing rollers 81*a*Y and 81*b*Y are arranged in this order from up stream to downstream in the drum rotation direction shown by the arrow B1, and respectively include developing sleeves 81*a*1Y and 81*b*1Y driven by the developing roller driving motor. Also included in the pair of developing sleeves 81*a*1Y and 81*b*1Y are respective magnetic rollers 81*a*2Y and 81*b*2Y each having plural magnetic poles to freely support thereof and carry magnetic brushes thereon.

The developing roller 81*a*Y is driven in the opposite direction to that of B1 at a developing nip in a developing region opposite the photoconductive drum 20Y where the developing sleeve 81*a*1Y supplies the toner in the developer thereto as the developing roller driving motor drives. The developing roller 81*b*Y is driven in the same direction as that of B1 at a developing nip in a developing region opposite the photoconductive drum 20Y where the developing sleeve 81*b*1Y supplies the toner in the developer thereto as the developing roller driving motor drives.

The doctor blade 82Y has cutting points on its both sides to chop and level the developer carried on the surface of the developing sleeve of the developing rollers 81*a*Y and 81*b*Y and to convey a prescribed appropriate amount thereof to the developing region.

The above-mentioned developing device 80Y is generally called a fountain type having a high developing performance that is capable of suppressing cut away of images both on leading and trailing ends thereof, which are generally caused as the developing roller rotates. Further, since only one doctor blade with the cutting edges at the both sides suffices the need, the apparatus can be compact. Thus, the fountain type-developing device is advantageously employed in a high-speed tandem image formation apparatus.

With the above-mentioned developing device 80Y, the developer leveled by the doctor blade 82Y to a prescribed amount is conveyed by the developing rollers 81*a*Y and 81*b*Y into the developing regions and attracts therefrom and develops the latent image on the photoconductive drum 20Y. Bias voltages are applied from the high voltage power supply to the developing rollers 81*a*Y and 81*b*Y so that only an image section is given the toner among the image present and absent sections of the latent image on the surface of the photoconductive drum 20Y, thereby a toner image is formed thereon.

Now, an exemplary principle capable of only attracting toner on developing rollers 81 to image formed sections is described. The below described voltages are one examples and can be changed by the controller 64 or in accordance with a change in environment.

Figure 3:
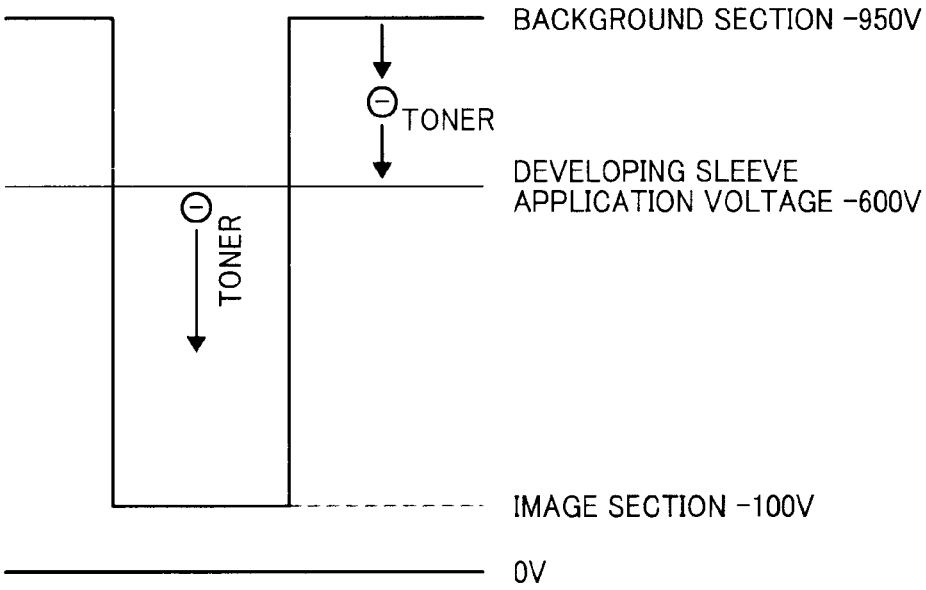
FIG. 3 schematically illustrates an exemplary principle of development executed by the developing device provided in the image forming apparatus of FIG. 1 according to one embodiment of the present invention.

The developing device 80Y employs a negative/positive process. As shown in FIG. 3, a background as a non-image section (i.e., a non-exposure section) of the photoconductive drum 20Y has a voltage of −950V. An image section (i.e., an exposure section) of the photoconductive drum 20Y has a voltage of about −100V. That is, when a surface of the photoconductive drum 20Y having a uniform charge of −950V receives a laser light from the optical scanning device 8, the background voltage maintains the voltage of −950V, but the voltage of the image section receiving such a laser light from the optical scanning device 8 changes to be about −100V. The high voltage power supply applies −600V with the same polarity as the charged toner to the developing sleeves 81*a*1Y and 81*b*1Y.

Thus, since a voltage heads from the image section with −100V to the developing sleeve with −600V in an electric field that is formed between the developing sleeves 81*a*1Y and 81*b*1Y and the image section, the toner with negative charge attracts to the image section. Whereas since a voltage heads from the developing sleeve with −600V to the image section with −950V in the electric field, the toner with negative charge does not attract to the background.

In this way, due to a difference in voltage between the developing sleeves 81*a*1Y and 81*b*1Y and the photoconductive drum 20Y, the toner with charge does not reach the background on the photoconductive drum 20Y. However, the toner on the developing sleeves 81*a*1Y and 81*b*1Y are drawn to the developing sleeves 81*a*1Y and 81*b*1Y. Specifically, the toner receives an electrostatic force and is pressed against the developing sleeves 81*a*1Y and 81*b*1Y.

Thus, when a signal for starting color image formation is inputted into the image forming apparatus 100 with the above-mentioned structure, a driving roller 72 is driven, and the transfer belt 11, the cleaning opposite roller 74, and the stretching rollers 33, 66, 67 and 75 are driven. At the same time, the photoconductive drums 20Y to 20Bk are driven in the direction B1.

As being driven in the direction B1, the photoconductive drums 20Y to 20Bk are uniformly charged by the charge devices 79Y to 79Bk, respectively, so that latent images of yellow to black color are formed by exposure of laser lights emitted from the optical scanning device 8. Then, these latent images are developed by toner of respective yellow to black component colors in the developing devices 80Y to 80Bk, thereby a monochrome images of magenta to black toner are formed.

These component color toner images of yellow to black thus obtained by the developing are transferred by the primary transfer rollers 12Y to 12Bk one after another on the same position of the transfer belt 11 that is rotated in the direction A1, respectively, thereby a synthesized color image is formed on the transfer belt 11.

Further, as a signal to form a color image is inputted or a copy switch is depressed, when the image forming apparatus constitutes a copier, one of sheet feeding devices provided in the paper bank 31 is selected and a transfer sheet S is launched therefrom one by one onto a sheet conveyance path 32 as the sheet feeding roller 3 arranged in the sheet feeding device rotates. The transfer sheet S launched onto the sheet-feeding path 32 is further conveyed by a conveyance roller, not shown, to collide with and stops at the pair of registration rollers 4.

In synchronism with coming of the synthesized color image on the transfer belt 11 to a secondary transfer section as the transfer belt 11 rotates, the pair of registration rollers 4 rotate and the synthesized color image contacts the transfer sheet S fed to the secondary transfer section 57. Thus, the synthesized color image is then transferred and printed onto the transfer sheet S due to function of nip pressure in a secondary transfer process.

The transfer sheet S is conveyed by the belt conveyance device 87 to the fixing device 6. The toner image of the synthesized color image is then subjected to heat and pressure and is thereby fixed when the sheet S passes through the fixing section between the fixing belt 92 and the pressing roller 94 in the fixing device.

The transfer sheet S with the fixed color image is ejected to an outside of the body via the sheet ejection roller 7, and is stacked on the sheet ejection tray 17 arranged on the body 99.

When toner remaining on the photoconductive drums 20Y to 20Bk are removed therefrom by the cleaning devices 71Y to 71Bk after the transfer process, changes thereon are then removed, and the photoconductive drums 20Y to 20Bk are subjected to the next charge process by the charge devices 79Y to 79Bk, respectively.

Having completed the secondary transfer process and passed through the secondary transfer section 57, the transfer belt 11 is subjected to a cleaning process of the cleaning blade 76 provided in the cleaning device 13 to prepare for the next transfer process.

Further, a reference toner image is formed on each of the photoconductive drums 20Y to 20Bk as a process control process between images formed based on designation of a user. Specifically, the reference toner image is formed within one rotational length of a developing roller from a trailing end of the previous image. The process control is executed for the purpose of obtaining uniform images by correcting a change in image formation performance of each of devices of the image forming apparatus 100 caused as time elapses. For example, a condition of toner image formation (i.e., image formation condition) on the photoconductive drums 20Y to 20Bk, such as a charge voltage, etc., caused by each of the charge devices 79Y to 79Bk, a developing performance, such as a developing bias, a toner density, etc., used in each of the developing devices 80Y to 80Bk, and a laser light intensity, such as a voltage on an image formation section caused in accordance with latent image writing intensity, etc., used in an optical scanning device 8 are controlled.

Such an image formation condition is controlled (adjusted) as mentioned below. For example, image density is controlled to become a reference level that corresponds to a target toner attraction amount, which is stored in a memory included in the controller 64. Thus, the controller 64 serves as an image formation condition controller and an image formation condition-setting device. The controller 64 and the memory collectively serve as a target image density memory device.

The reference toner image is formed on prescribed (same or different) positions on the transfer belt 11 in the respective image formation units 60Bk to 60C when a power supply is turned on or a prescribed number of image formations is completed in the image forming apparatus 100 for the purpose of detecting a change in image formation performance.

The toner sensor 90 then detects toner density or an amount of toner of respective reference component color toner images. Based on the detection result, the controller 64 adjusts appropriate one or more of the image formation conditions of the above-mentioned charge voltages on the photoconductive drums 20Y to 20Bk caused by the charge devices 79Y to 79Bk, the developing conditions of the developing biases and/or the toner density in the developing devices 80Y to 80Bk, and the laser light intensity of the optical scanning device, i.e., latent image writing intensity changing the voltage on the image formation section.

The toner sensor 90 can serve as an image formation position detector that detects positions and execute positioning of the respective component color toner images on the transfer belt 11.

Now, an exemplary result of detecting density in a whole area of a solid image is described with reference to FIG. 4. As shown, the density is illustrated from a leading end to a trailing end of the solid image formed right after formation of a previous image that does not carry any image sections (i.e., blank) thereon. As shown, a lengthwise direction of the transfer sheet S accords with that of a circular (length) direction (i.e., a rotational direction) of each of the respective developing rollers 81*a*Y and 81*b*Y and the developing sleeves 81*a*1Y and 81*b*1Y.

Figure 4:
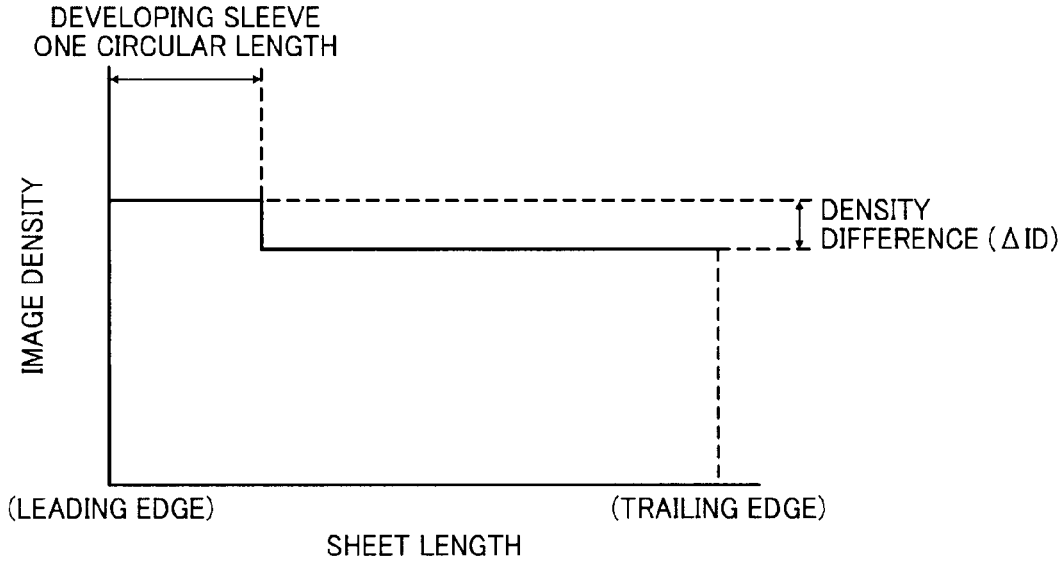
FIG. 4 schematically illustrates exemplary change in image density in a circular direction of a toner bearer according to one embodiment of the present invention.

It is understood from FIG. 4 that image density is different in a prescribed width in the leading end section of the image than the other section thereof to be darker by about 0.1 degree. Such a difference apparently increases when a color image is formed by superimposing plural monochrome color images, such as dual color solid image, etc.

Further, it is revealed after investigation as to the prescribe (length) width that the prescribed (length) width corresponds to one circumference of the developing rollers 81*a*Y and 81*b*Y, and accordingly, the developing sleeves 81*a*1Y and 81*b*1Y.

It is further revealed that when the toner attracts to the developing sleeves 81*a*1Y and 81*b*1Y being charged with the same polarity as the developing bias, it is regarded that the developing bias is substantially generated on the surface of the developing sleeves, even if the developing bias is not applied.

Figure 5:
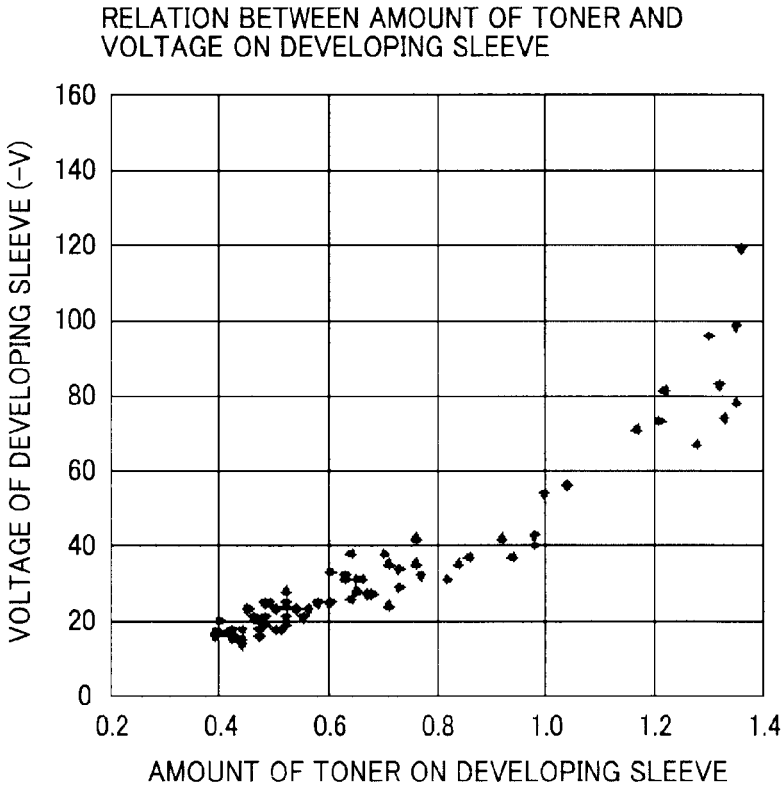
FIG. 5 schematically illustrates exemplary correlation between toner density and a voltage on the toner bearer according to one embodiment of the present invention.

Now, an exemplary relation between density of toner on a typical developing sleeve or an amount of the toner attracting thereto and a voltage on the surface thereof when toner normally or firmly attracts thereto is described with reference to FIG. 5. Such density is detected based on a solid toner image formed on a surface of a developing sleeve by a reflection light detector when carrier is separated from the developing sleeve. A bias voltage is not applied during the detection of the toner density. As shown, it is understood that as the toner less attracts, the detection value decreases. Whereas when the toner comes to normally or firmly attract, the detection value increases. Thus, in proportion to an amount of toner normally or firmly attracting, a surface voltage of the developing sleeve increases, for example, by an amount of a voltage of the developing sleeve surface as shown in FIG. 5. Further, such increase or decrease in the amount of normally or firmly attracting toner shows substantially the same tendency as that of an image area ratio of a previous image that is formed right before the current image formation.

Thus, from FIGS. 4 and 5, it is understood that the image density is affected by the image area ratio of the previous image formed right before the current image formation. Specifically, when the image area ratio of the previous image is relatively low and a lot of toner remains on the developing sleeve after the formation thereof, an effective bias on? the developing sleeve increases due to the toner remaining thereon, and accordingly, density of the next image increases at least by one circumference of the developing sleeve.

Specifically, as shown in FIG. 4, a phenomenon that density of a solid image is darker by one circumference of a developing sleeve from the leading end thereof shows a condition in that a lot of toner attracts to the surface of the developing sleeve after formation of a previous image that has not any image sections thereon, and is caused due to increase in both effective developing bias and an amount of toner used for developing. Thus, if the developing sleeve rotates once and a solid image is developed at the time, a lot of toner attracting to the developing sleeve separates therefrom due to electrostatic force during the development. Thus, an effective developing bias for the second rotation of the developing sleeve decreases down to about a level that is practically applied thereto, so that an amount of toner used for the developing of the second and subsequent rotations decreases than that in the first rotation. As a result, the density varies.

Such a phenomenon also occurs in the process control, and accordingly, an amount of toner used in a reference toner image and detected by the toner sensor 90 is affected by a previous image area ratio formed right before the formation of the reference toner image. Thus, when the process control is executed simply based on the toner amount of the reference toner image detected by the toner sensor 90, density of an image formed thereafter likely deviates from an appropriate range due to the image area ratio of the image formed right before formation of the reference toner image. Specifically, when the image area ratio of the image formed right before formation of the reference toner image is relatively low and the reference toner image positions within one circumference of the developing sleeve from a position where the previous image is formed, an amount of the toner of the reference toner image is detected by the toner sensor 90 as being more than that to be practically detected. As a result, the process control is executed to lower the image density than an appropriate level.

Then, according to one embodiment of the image forming apparatus 100, an amount of toner of a reference toner image detected by a toner sensor 90 is corrected in accordance with an image area ratio of an previous image formed right before formation of the reference toner image with the below described correction formula, and the process control is thereafter executed by the controller 64 based on the corrected toner amount, wherein M' [mg/cm$^2$] represents an amount of toner attracting to a reference toner image after providing the correction (or a correction toner amount), M [mg/cm$^2$] represents an amount of toner attracting to a reference toner image before providing the correction (or a reference toner image detection amount), $\alpha$ represents a constant ($0<\alpha<1$), and A [%] represents an image area ratio of a portion on a previous image, which precedes the reference toner image by one circumference of a developer carrier.

$$M'[\mathrm{mg/cm^2}]=M[\mathrm{mg/cm^2}]-M[\mathrm{mg/cm^2}]\times\alpha(1-A[\%]/100) \quad (1)$$

The correction formula 1 is implemented by the controller 64 to calculate a correction amount of toner. With the above-mentioned correction, the larger the image area ratio A, the greater the correction calculation amount of toner. Thus, density of successive images is prevented or suppressed from extraordinarily increasing. At the same time, the smaller the image area ratio A, the smaller the calculation correction amount of toner. Thus, image density of successive images is prevented or suppressed from extraordinarily decreasing. As a result, the process control can maintain stable image density even if time elapses.

The coefficient $\alpha$ is predetermined through experiment or the like. However, the coefficient $\alpha$ can be updated based on toner attraction amount detection result in the below described manner. Specifically, solid image patterns having a longitudinal band shape are formed at a prescribed time after formation of previous image having image area ratio of 0% and that of 100%, respectively, and respective toner attraction amounts are detected and compared with each other. Based on the comparison, the coefficient $\alpha$ is updated.

The correction formula 1 can be high-order formula. For example, plural image area ratios of respective images formed right before the formation of the reference toner image on the photoconductive drums 20Y to 20Bk over widths of a prescribed integer multiple of the circumference of each of the developing sleeves can be utilized for the correction.

In such a situation, the below described correction formula 2 can be employed, and prescribed process control is executed based on an image area ratio in accordance with plural rotations of each of the developing sleeves, wherein M' [mg/cm$^2$] represents an amount of toner attracting to a reference toner image after proving correction (or a correction toner amount), M [mg/cm$^2$] represents an amount of toner attracting to a reference toner image before providing correction (or a reference toner image detection amount), $\alpha$ i represents constants ($0<\alpha_N<\ldots<\alpha_2<\alpha_1<1$), and Ai [%] represents an image area ratio of a portion of a previous image, which portion precedes the reference toner image by an i-multiple of the circumference of a developer carrier.

$$M'[\mathrm{mg/cm^2}]=M[\mathrm{mg/cm^2}]-M[\mathrm{mg/cm^2}]\times\alpha_1(1-A_1[\%]/100)-M[\mathrm{mg/cm^2}]\times\alpha_2(1-A_2[\%]/100)\ldots-M[\mathrm{mg/cm^2}]\times\alpha_N(1-A_N[\%]/100) \quad (1)$$

With the above-mentioned second correction, the larger the image area ratio Ai, the larger the corrected toner calculation amount. Thus, density of successive images is prevented or suppressed from extraordinarily increasing. Whereas, the smaller the image area ratio Ai, the smaller the corrected toner calculation amount. Thus, image density of successive images is prevented or suppressed from extraordinarily decreasing. As a result, the process control can maintain stable image density even time elapses.

The coefficient $\alpha$ i is predetermined through experiment or the like. The coefficient $\alpha$ i can be updated as follows.

Solid image patterns having a longitudinal band shape are formed at a prescribed time after images having the image area ratio of 0% on a portion of the previous image one circumference of the developing sleeve prior to the reference toner image and that of 100%, respectively. An amount of toner of those Solid image patterns are then detected and compared with the other. Then, based on the comparison, the coefficient $\alpha$ i is updated.

To implement the above-mentioned correction formulas, the controller 64 calculates an image area ratio per rotation of the developing sleeve. The image area ratio can be detected by counting a number of times of laser light emission to a surface of a photoconductive drum in an exposure process. The controller 64 and the memory store all of the image area ratios calculated. However, to reduce capacity of the memory for storing the image area ratios, only one image area ratio can be stored by overwriting a previous vale with new one at every new calculation thereof when the first formula is implemented. Further, N items of image area ratios needed for implementation the second formula are stored omitting unnecessary rest of those when the second formula is implemented. Further, the memory can be reset deleting the image area ratios stored therein when the process control is terminated.

The memory of the controller 64 stores image formation control program for implementing an image formation method capable of adjusting conditions for forming toner images on the respective photoconductive drums 20Y to 20Bk based on a corrected toner amount that is calculated by the correction toner amount calculation device.

Such program can be stored in another storage medium, such as a ROM and a Non-volatile memory of semiconductor, a DVD, a MO, a MD, a CD-R of an optical medium, and a HD, a magnetic tape, and a flexible disc of a magnetic medium or the like each serving as a computer readable medium.

The above-mentioned toner amount detector can detect an amount of toner of the reference toner image bore on the image bearer or transferred on one of the intermediate transfer belt 11 and the transfer sheet S from the respective photoconductive drums 20Y to 20Bk.

The above-mentioned image forming apparatus 100 can selectively use one of a corrected or a not corrected toner amount in the process control.

The toner bearer is not limited to a cylindrical type as above, and can employ an endless belt member as far as one rotation length is specified.

One and two component developer can be employ. One drum type image forming apparatus 100 can be employed to form respective color toner images one after another on one photoconductive drum to superimpose them as a color image. A monochrome image forming apparatus can also be employed to adopt the above-mentioned various embodiments of the present invention. The respective toner images can be directly transferred onto a transfer sheet S omitting an intermediate transfer member.

ADVANTAGE OF THE INVENTION

According to the one embodiment of the present invention, density of an image can be stable even as time elapses.

Numerous additional modifications and variations of the present invention are possible in latent image of the above teachings. It is therefore to be understood that within the scope of the appended claims, the present invention may be practiced otherwise that as specifically described herein.

What is claimed is:

1. An image forming apparatus comprising:

an image bearer configured to bear toner images and a reference toner image therebetween;

a toner amount detector configured to detect an amount of toner in the reference toner image;

a detected toner amount correction device configured to correct the amount of toner detected by the toner amount detector in the reference toner image based on a measured parameter of at least one portion of a previous toner image formed just before formation of the reference toner image; and a controller configured to change a condition of formation of subsequent toner images based on the corrected toner amount.

2. The image forming apparatus as claimed in claim 1, wherein the measured parameter of the at least one portion of the previous toner image is an image area ratio of the at least one portion of the previous toner image.

3. The image forming apparatus as claimed in claim 2, wherein said detected toner amount correction device is configured to determine a correction amount of toner that corrects the detected toner amount in the reference toner image in proportion to an image area ratio of the previous toner image, and wherein the correction amount of toner is greater when the image area ratio is relatively large.

4. The image forming apparatus as claimed in claim 2, wherein said detected toner amount correction determines a correction amount of toner that corrects the detected toner amount in the reference toner image in proportion to an image area ratio of the previous toner image, and wherein the correction amount of toner is lesser when the image area ratio is relatively small.

5. The image forming apparatus as claimed in claim 2, wherein said detected toner amount correction device is configured to determine a correction amount of toner that corrects the detected toner amount in the reference toner image based on the image area ratio of the at least one portion of the previous toner image and a coefficient of toner correction.

6. The image forming apparatus as claimed in claim 5, wherein said detected toner amount correction device is configured to do a comparison of a toner attraction amount detected for the reference image and a previous toner attraction amount of the previous image and update the coefficient of toner correction based on the comparison.

7. The image forming apparatus as claimed in claim 1, further comprising an endless rotary toner bearer configured to bear the toner for forming the toner images and the reference toner image on the image bearer, wherein said at least one portion of the previous toner image precedes the reference toner image on the image bearer by a length that is equivalent to the circumference of the endless rotary toner bearer.

8. The image forming apparatus as claimed in claim 1, further comprising an endless rotary toner carrier configured to carry the toner for forming the toner image and the reference toner image on the image bearer, wherein said at least one portion of the previous toner image precedes the reference toner image on the image bearer by a length that is equivalent to an integer multiple of the circumference of the toner bearer, wherein said previous toner image is formed on the image bearer over an integer multiple of the circumference of the endless rotary toner bearer.

9. A method of forming a toner image, comprising the steps of:

detecting an amount of toner of a reference toner image formed on an image bearer;

correcting the detected amount of toner of the reference toner image based on a measured parameter of at least one portion of a previous image formed just before the formation of the reference toner image; and changing a prescribed condition of forming subsequent toner images on the image bearer based on the corrected detection amount of toner.

* * * * *